US012527985B1

(12) United States Patent
He

(10) Patent No.: US 12,527,985 B1
(45) Date of Patent: Jan. 20, 2026

(54) LUMINOUS JUMPING BALL

(71) Applicant: Zhiang He, Yongkang (CN)

(72) Inventor: Zhiang He, Yongkang (CN)

( * ) Notice: Subject to any disclaimer, the term of this patent is extended or adjusted under 35 U.S.C. 154(b) by 0 days.

(21) Appl. No.: 19/299,368

(22) Filed: Aug. 14, 2025

(30) Foreign Application Priority Data

Jul. 11, 2025 (CN) ..... 202521460056.5

(51) Int. Cl.
*A63B 5/22* (2006.01)

(52) U.S. Cl.
CPC ..... *A63B 5/22* (2013.01); *A63B 2225/74* (2020.08)

(58) Field of Classification Search
CPC ..... A63B 5/22; A63B 2225/74
See application file for complete search history.

(56) References Cited

U.S. PATENT DOCUMENTS 3,140,871 A * 7/1964 Liquori ..... A63B 5/22 473/576
3,165,315 A * 1/1965 Petrusek ..... A63B 5/22 473/576
3,528,654 A * 9/1970 Larson ..... A63B 5/22 446/26
3,548,185 A * 12/1970 Hall ..... B60Q 1/326 310/91
3,935,669 A * 2/1976 Potrzuski ..... A63H 5/00 362/802
4,480,831 A * 11/1984 Muller-Deinhardt ..... A63B 21/0608 446/236
4,648,610 A * 3/1987 Hegyi ..... A63C 17/26 446/438
4,813,665 A * 3/1989 Carr ..... A63B 5/22 482/3
4,875,675 A * 10/1989 Arad ..... A63B 5/22 482/81
5,593,154 A * 1/1997 Allen ..... A63B 69/0079 473/429
5,603,651 A * 2/1997 Shure ..... A63H 33/28 446/16
5,888,179 A * 3/1999 Singhal ..... A63B 69/0053 482/3

(Continued)

FOREIGN PATENT DOCUMENTS

BG 112189 A * 6/2017 ..... A63B 71/0054
CN 216603921 U * 5/2022 ..... A63B 5/20

(Continued)

*Primary Examiner* — Sundhara M Ganesan
(74) *Attorney, Agent, or Firm* — Zhigang Ma

(57) ABSTRACT

A luminous jumping ball includes a connecting rod, an ankle ring, and a roller. The ankle ring is fixedly connected to an end of the connecting rod, another end of the connecting rod facing away from the ankle ring is rotatably connected to a rotatable sleeve, the rotatable sleeve is fixedly connected to the roller through a spring, two ends of the spring are fixedly connected to an end of the rotatable sleeve and an end of the roller, respectively, and the spring, the rotatable sleeve, and the roller are coaxially arranged. The connecting rod and the roller are connected through the spring. When the roller collides with the ground, the spring acts as a cushion to prevent damage caused by rigid connection during the collision, thereby increasing a service life of the jumping ball and a smoothness of rotation of the roller.

10 Claims, 4 Drawing Sheets

(56) References Cited

U.S. PATENT DOCUMENTS 6,113,452 A * 9/2000 McGowan ..... A63B 5/22 446/236
6,220,733 B1 * 4/2001 Gordon ..... B60Q 1/326 362/500
6,695,671 B2 * 2/2004 Kessler ..... A63B 5/22 482/81
6,776,679 B1 * 8/2004 Menow ..... A63B 5/22 446/236
7,195,534 B1 * 3/2007 Millman ..... A63B 5/22 446/236
12,146,651 B1 * 11/2024 Cao ..... F21L 4/02
2003/0027484 A1 * 2/2003 Kessler ..... A63B 5/22 446/247
2004/0097344 A1 * 5/2004 Kessler ..... A63B 5/22 482/81
2004/0204299 A1 * 10/2004 Shirley ..... A63B 24/0021 473/576
2007/0032354 A1 * 2/2007 Bazinet ..... A63B 5/22 482/81
2013/0084769 A1 * 4/2013 Kessler ..... A63B 69/0079 482/81
2013/0324367 A1 * 12/2013 Lam ..... A63H 33/18 482/2
2023/0105076 A1 * 4/2023 Michelsen ..... A63B 5/22 446/246

FOREIGN PATENT DOCUMENTS

DE 202011003693 U1 * 7/2011 ..... A63B 5/22
DE 102014016403 A1 * 5/2016 ..... A63B 69/0086
EP 0384953 A1 * 9/1990 ..... A63B 5/22
EP 1415684 A1 * 5/2004 ..... A63B 5/22
KR 20100102074 A * 9/2010 ..... A63B 5/22

* cited by examiner

LUMINOUS JUMPING BALL

TECHNICAL FIELD

The disclosure relates to the field of jumping ball, and particularly to a luminous jumping ball.

BACKGROUND

Jumping ball is a children's toy ball, which includes a rod-like structure or a rope connecting a roller and a loop. During play, the loop is worn around ankles of an user, and the roller rotates around the ankle under foot control of the user.

However, in the current jumping ball, the roller and rod-like structure are rigidly connected. This rigid connection causes the roller to intermittently impact the ground during use, subjecting the roller to radial forces. The radial forces lead to roller wobbling, which over time creates increased assembly clearance between the roller and rod-like structure. Consequently, friction increases, resulting in reduced rotational flexibility of the roller. To address the problems, the disclosure proposes a luminous jumping ball.

SUMMARY

A purpose of the disclosure is to provide a luminous jumping ball, which solves the problem of wheels of the current jumping balls not rotating flexibly during use.

The disclosure is achieved by the technical solutions as follows.

In an embodiment, a luminous jumping ball includes a connecting rod, an ankle ring, and a roller. The ankle ring is fixedly connected to an end of the connecting rod, another end of the connecting rod facing away from the ankle ring rotatably connected to a rotatable sleeve, the rotatable sleeve is fixedly connected to the roller through a spring, two ends of the spring are fixedly connected to an end of the rotatable sleeve and an end of the roller, respectively, and the spring, the rotatable sleeve, and the roller are coaxially arranged.

In an embodiment, the rotatable sleeve is rotatably connected to the another end of the connecting rod facing away from the ankle ring through a second bearing.

In an embodiment, the luminous jumping ball further includes a first light-emitting assembly, and the first light-emitting assembly is located in the roller.

In an embodiment, the roller further includes: a wheel body, the first light-emitting assembly includes a first magnetic sleeve, a first coil, and lamp beads, the first magnetic sleeve is rotatably connected to an inner side of the wheel body, and the first coil is fixedly connected to the inner side of the wheel body, and the first coil is located outside the first magnetic sleeve and is electrically connected to the lamp beads.

In an embodiment, the roller further includes: a protective shell, the protective shell is a light-transmitting ring, and the protective shell is fixedly connected to an outer edge of the wheel body, and thereby the protective shell covers outer sides of the lamp beads.

In an embodiment, the luminous jumping ball further includes a second light-emitting assembly, and the second light-emitting assembly is configured to generate light on the connecting rod.

In an embodiment, the connecting rod is a hollow tube, and the connecting rod defines multiple light-transmitting holes. The second light-emitting assembly includes: a second magnetic sleeve, a second coil, and a light strip. The second magnetic sleeve is fixedly connected to the rotatable sleeve, and the second coil is located outside the second magnetic sleeve, and the second coil is fixed to the connecting rod. The light strip is electrically connected to the second coil.

In an embodiment, the luminous jumping ball further includes a counting assembly, and the counting assembly is configured to count a rotation number of the roller.

In an embodiment, an anti-friction flexible sleeve is sleeved on the ankle ring.

In an embodiment, the luminous jumping ball further includes a BLUETOOTH™ integrated chip, the BLUETOOTH™ integrated chip is configured to connect to a smart terminal and transmit data, and the BLUETOOTH™ integrated chip is electrically connected to a speaker configured to play audio sent from the smart terminal.

In the luminous jumping ball disclosed in the embodiments of the disclosure, the connecting rod and the roller are connected through the spring. When the roller collides with the ground, the spring acts as a cushion to prevent damage caused by rigid connection during the collision, thereby increasing a service life of the jumping ball and a smoothness of rotation of the roller.

DESCRIPTION OF REFERENCE NUMERALS

Figure 1:
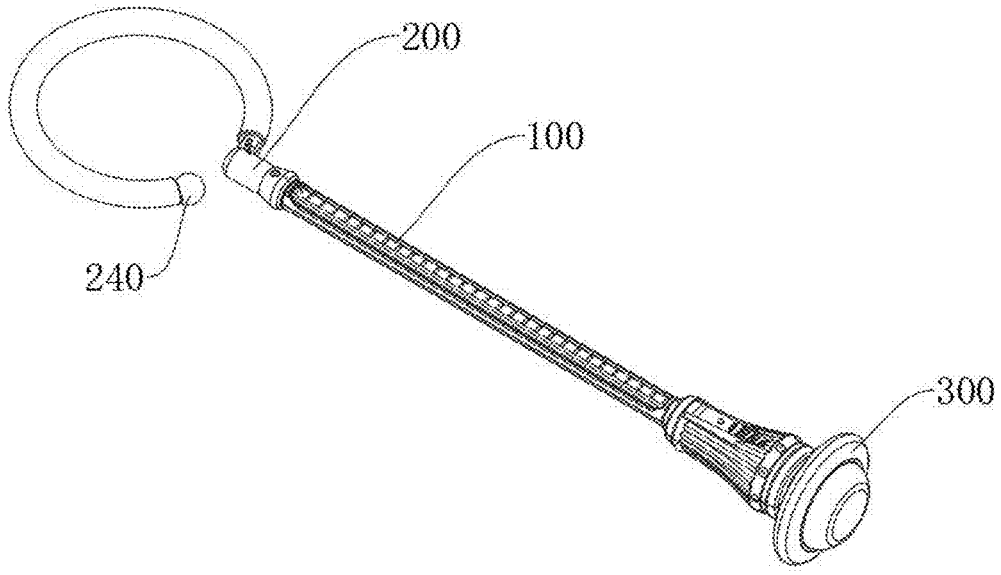
FIG. 1 illustrates an overall schematic structural diagram of a luminous jumping ball in an embodiment of the disclosure.
Figure 2:
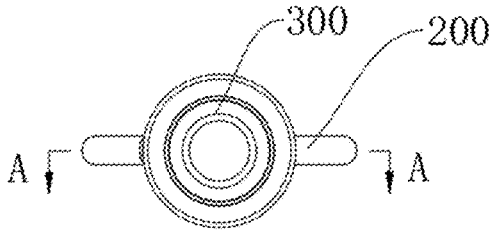
FIG. 2 illustrates a bottom view of the luminous jumping ball in the embodiment of the disclosure.
Figure 3:
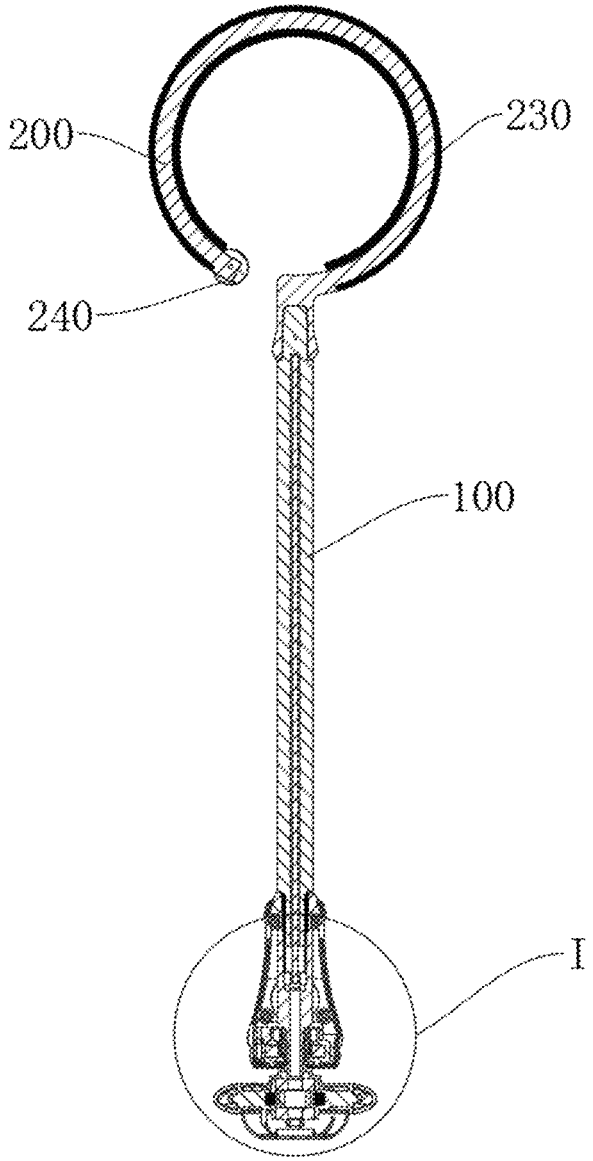
FIG. 3 illustrates a cross-sectional structural diagram taken along a line A-A illustrated in FIG. 2 of the disclosure.

100, connecting rod; 110, first half-rod; 111, light-transmitting hole; 120, second half-rod; 130, end sleeve; 140, anti-slip sleeve; 150, limiting sleeve; 200, ankle ring; 210, ring body; 220, fixing sleeve; 230, anti-friction flexible sleeve; 240, protective ball head; 300, roller; 310, wheel body; 311, connecting shell; 312, wheel spoke; 320, first light-emitting assembly; 321, first magnetic sleeve; 322, first coil; 323, lamp bead; 324, first bearing; 330, protective shell; 340, end shell; 350, rotatable sleeve; 351, second bearing; 360, spring; 400, second light-emitting assembly; 410, second magnetic sleeve; 420, second coil; 430, light strip; 500, circuit board; 510, counting assembly; 511, magnet block; 512, Hall sensor; 513, digital display screen; 520, storage battery; 530, speaker; 540, dust-proof shell.

DETAILED DESCRIPTION OF EMBODIMENTS

The technical solutions in the embodiments of the disclosure will be clearly and comprehensively described below with reference to the attached drawings. Apparently, the described embodiments are only a part of the embodiments of the disclosure, not all of them. Based on the embodiments of the disclosure, all other embodiments obtained by those skilled in the art without creative labor fall within the scope of protection of the disclosure.

Embodiment 1

As shown in FIGS. 1 to 4, a luminous jumping ball is provided, which includes a connecting rod 100, an ankle ring 200, and a roller 300. The ankle ring 200 is fixedly connected to an end of the connecting rod 100, another end of the connecting rod 100 facing away from the ankle ring 200 is rotatably connected to a rotatable sleeve 350, the rotatable sleeve 350 is fixedly connected to the roller 300 through a spring 360, two ends of the spring 360 are fixedly connected to an end of the rotatable sleeve 350 and an end of the roller 300, respectively, and the spring 360, the rotatable sleeve 350, and the roller 300 are coaxially arranged.

In the embodiment, when the user uses the luminous jumping ball of the disclosure, the ankle ring 200 is worn around ankles of the user. The jumping ball is played with in the traditional manner, that is, by swinging the jumping ball using the ankles. During the rotation of the jumping ball, when the roller 300 collides with the ground, the spring 360 acts as a cushion, that is, the spring 360 bends. As the roller 300 rolls, the spring 360 drives the rotatable sleeve 350 to roll on the connecting rod 100. The connection between the roller 300 and the connecting rod 100 is a flexible connection, thereby reducing damage.

In the luminous jumping ball of the disclosure, the connecting rod 100 and the roller 300 are connected through the spring 360. When the roller 300 collides with the ground, the spring 360 acts as a cushion to prevent damage caused by rigid connection during the collision, thereby increasing the service life of the jumping ball and the smoothness of rotation of the roller 300.

Specifically, in the embodiment, the connecting rod 100 is a cylindrical structure, and the connecting rod 100 is fixedly connected to the ankle ring 200.

The ankle ring 200 includes a ring body 210 and a fixing sleeve 220, the ring body 210 and the fixing sleeve 220 are an integral structure, the ring body 210 is a circular ring structure defined with a notch, the fixing sleeve 220 is located at an end of the ring body 210, the end of the connecting rod 100 is inserted into an interior of the fixing sleeve 220, and the fixing sleeve 220 and the connecting rod 100 are tightened together by a screw.

In an embodiment, an anti-friction flexible sleeve 230 is also sleeved on the ring body 210. The anti-friction flexible sleeve 230 is a rubber tube or an ethylene vinyl acetate (EVA) sponge tube and is configured to provide cushioning. The ring body 210 has an arc degree of at least 270 degrees.

In an embodiment, a protective ball head 240 is also disposed at the end of the ring body 210 facing away from the fixing sleeve 220. The protective ball head 240 is connected to the end of the ring body 210 by adhesive bonding or screw fastening. The protective ball head 240 is configured to prevent scratching.

The rotatable sleeve 350 is a tubular structure with openings at two ends. The rotatable sleeve 350 is rotatably connected to the end of the connecting rod 100 facing away from the ankle ring 200 through a second bearing 351. The spring 360 is fixedly connected to the rotatable sleeve 350 and the roller 300 by an interference fit. The roller 300 is provided with a connecting shell 311, which is a disc-shaped structure. A center of the connecting shell 311 is provided with a cylindrical structure. The spring 360 is mounted at centers of the rotatable sleeve 350 and the connecting shell 311.

When the roller 300 rotates, the roller 300 drives the rotatable sleeve 350 to rotate on the connecting rod 100 through the spring 360, thereby enabling the roller 300 to rotate smoothly.

Embodiment 2

As a specific embodiment, the difference between the embodiment 1 and the embodiment 2 lies in that the luminous jumping ball further includes: a first light-emitting assembly 320, the first light-emitting assembly 320 is located in the roller 300 and is configured to generate lighting effect.

Figure 4:
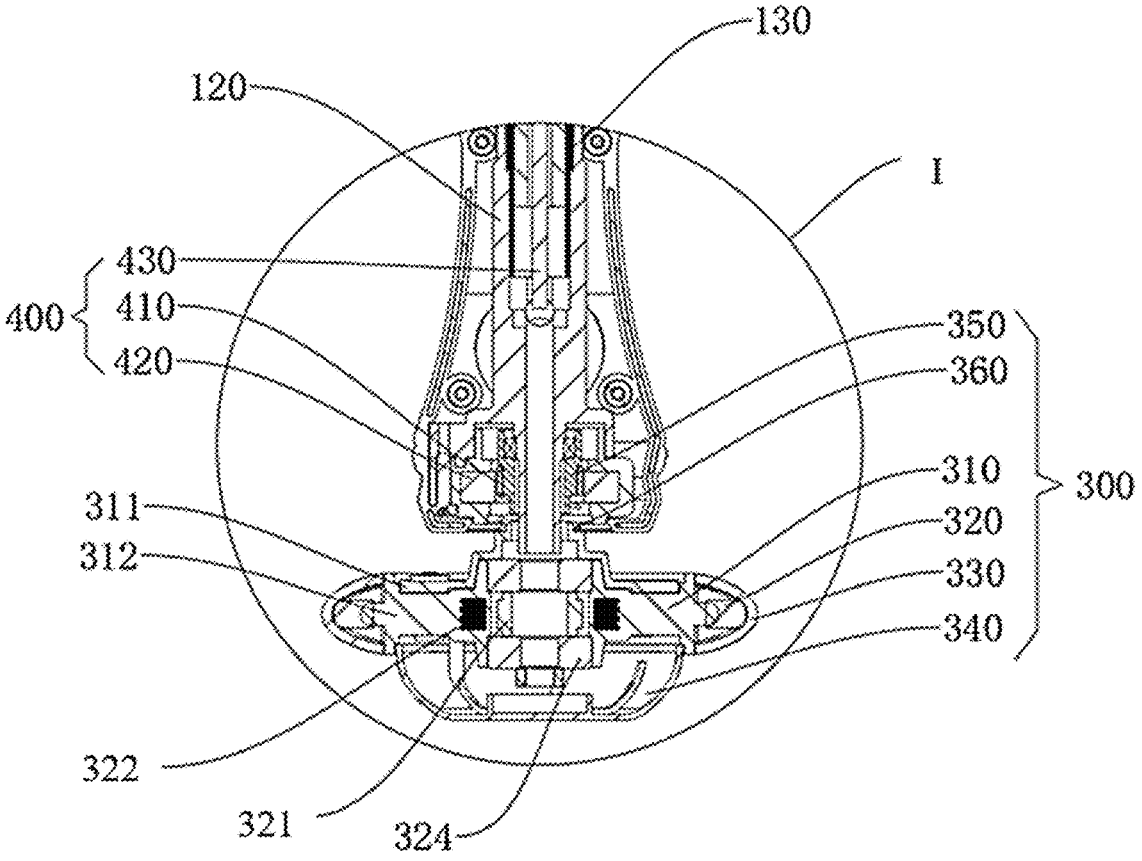
FIG. 4 illustrates an enlarged structural diagram of a portion I illustrated in FIG. 3 of the disclosure.
Figure 5:
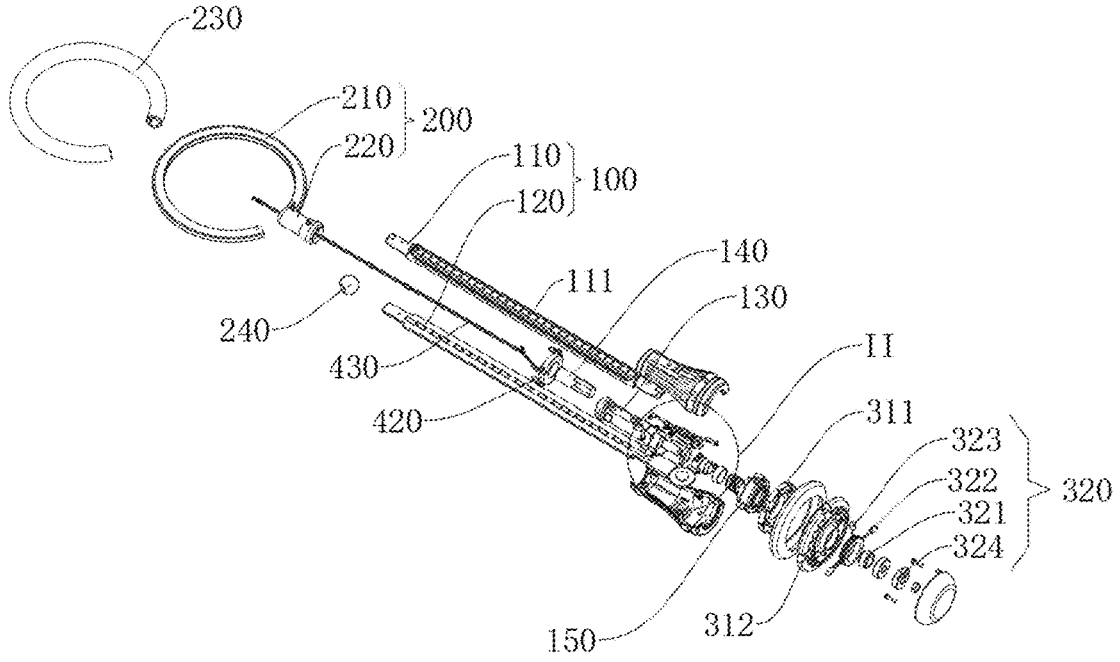
FIG. 5 illustrates an exploded diagram of the luminous jumping ball in the embodiment of the disclosure.
Figure 6:
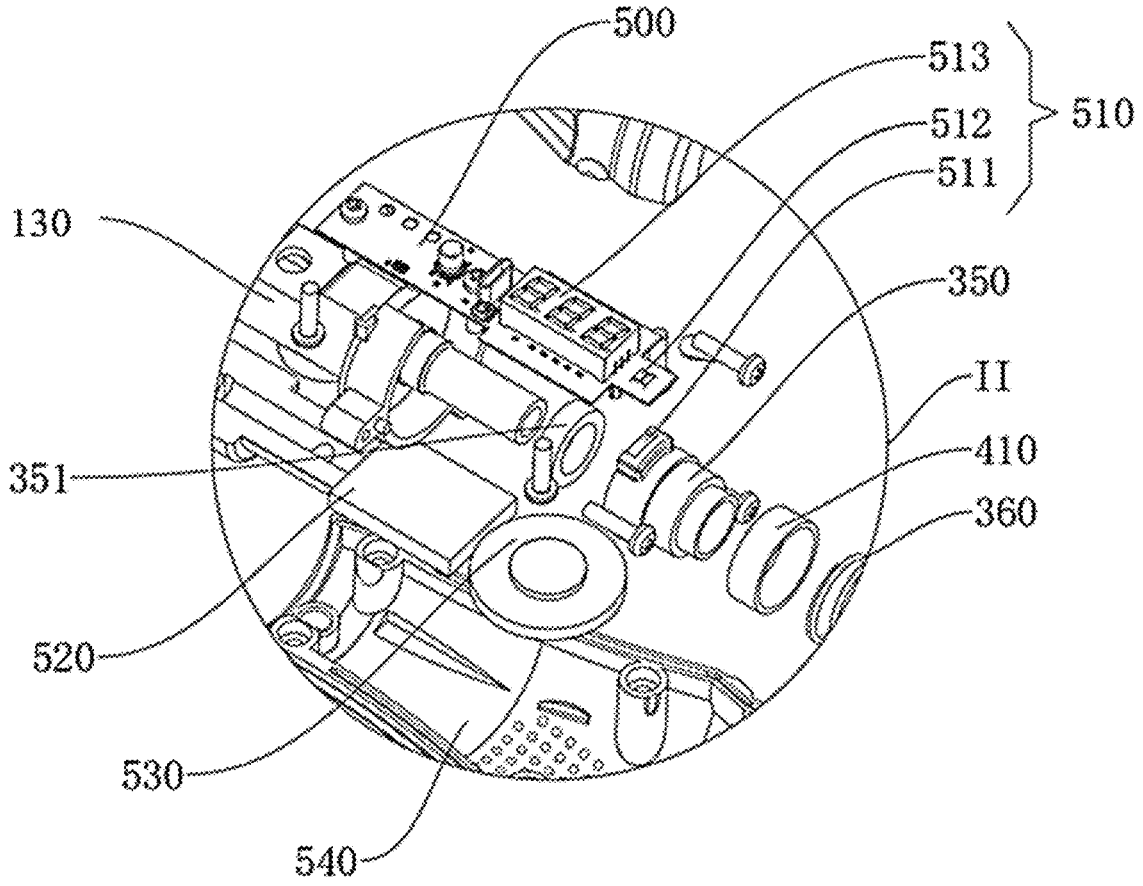
FIG. 6 illustrates an enlarged structural diagram of a portion II illustrated in FIG. 5 of the disclosure.

Specifically, as shown in FIGS. 4 to 6, the roller 300 includes a wheel body 310, a first light-emitting assembly 320, and a protective shell 330. The wheel body 310 includes a connecting shell 311 and a wheel spoke 312. The wheel spoke 312 is annular. The connecting shell 311 is fixedly connected to the wheel spoke 312 by bolts. The first light-emitting assembly 320 includes a first magnetic sleeve 321, a first coil 322, and lamp beads 323. The first magnetic sleeve 321 is rotatably connected to the inner side of the wheel spoke 312. Specifically, two ends of the first magnetic sleeve 321 are fixed with a first bearing 324, and the first bearing 324 is fixedly connected to the inner ring of the wheel spoke 312. The outer side of the first magnetic sleeve 321 is provided with multiple magnet blocks arranged in a circumferential direction of the first magnetic sleeve 321. The first coil 322 is fixedly connected to the inner side of the wheel spoke 312 and is provided with multiple coil structures arranged in a circumferential direction of the first coil 322. The first magnetic sleeve 321 and the first coil 322 constitute the rotor and stator structures of a generator. The first coil 322 is located outside the first magnetic sleeve 321 and is electrically connected to the lamp beads 323. When the roller 300 rotates, the first magnetic sleeve 321 rotates relative to the first coil 322 due to inertia, thereby changing the magnetic flux of the first coil 322, which generates an electric current. The current in the first coil 322 causes the lamp beads 323 to emit light. The lamp beads 323 are located on the outer edge of the wheel spoke 312, which is provided with a groove structure for accommodating the lamp beads 323.

Specifically, the roller 300 further includes a protective shell 330. The protective shell 330 is a light-transmitting ring. A cross-section of the protective shell 330 is in a shape of a circular groove. The protective shell 330 is fixedly connected to an outer edge of the wheel spoke 312, so that the protective shell 330 covers the outer side of the lamp beads 323 for protecting the lamp beads 323. The protective shell 330 is made of transparent plastic.

Specifically, the roller 300 further includes an end shell 340, which is fixedly connected to a side of the wheel spoke 312 facing away from the connecting shell 311 by screws. The end shell 340 is configured to protect the protective shell 330.

Embodiment 3

As a specific embodiment, the difference between the embodiment 1 and the embodiment 3 lies in that the luminous jumping ball further includes: a second light-emitting assembly 400, the second light-emitting assembly 320 is configured to generate light.

Specifically, as shown in FIGS. 1 to 6, the connecting rod 100 includes a first half-rod 110 and a second half-rod 120 that are symmetrically arranged. Both the first half-rod 110 and the second half-rod 120 are semi-cylindrical structures obtained by cutting a cylindrical structure along the axial plane. Surfaces of the first half-rod 110 and the second half-rod 120 that face each other are provided with groove structures extending along their the axes, which are configured to accommodate the second light-emitting assembly 400. The first half-rod 110 and the second half-rod 120 are connected by a snap-fit structure or a screw structure, forming a cylindrical structure.

The second light-emitting assembly 400 includes a second magnetic sleeve 410, a second coil 420, and a light strip 430. The second magnetic sleeve 410 is fixedly connected to the rotatable sleeve 350. The second magnetic sleeve 410 is provided with multiple magnet blocks arranged in a circumferential direction of the second magnetic sleeve 410. The second coil 420 is located outside the second magnetic sleeve 410 and is provided with multiple coil structures arranged in a circumferential direction of the second coil 420. The second magnetic sleeve 410 and the second coil 420 constitute the rotor and stator structures of a generator. The second coil 420 is electrically connected to the light strip 430. When the rotatable sleeve 350 rotates with the roller 300, the rotatable sleeve 350 drives the second magnetic sleeve 410 to rotate, thereby changing a magnetic flux of the second coil 420 and generating an electric current. The light strip 430 is located inside the first half-rod 110.

The end of the connecting rod 100 facing away from the ankle ring 200 is fixedly connected to an end sleeve 130. The end sleeve 130 is a tubular structure with an opening at an end. The first half-rod 110 and the end sleeve 130 are fixedly connected by an interference fit. An anti-slip sleeve 140 is also disposed between the first half-rod 110 and the end sleeve 130. The anti-slip sleeve 140 is made of rubber. The light strip 430 passes through the end sleeve 130 and is located inside the first half-rod 110. The end of the end sleeve 130 facing away from the first half-rod 110 is fixedly connected to a limiting sleeve 150. The limiting sleeve 150 is an annular structure. The second coil 420 is fixedly connected to the inner side of the limiting sleeve 150.

Specifically, both the first half-rod 110 and the second half-rod 120 are provided with multiple light-transmitting holes 111 in an array. The light-transmitting holes 111 of the first half-rod 110 connect the inner side and the outer side of the first half-rod 110. The light generated by the light strip 430 is emitted through the light-transmitting holes 111.

In addition, the first half-rod 110 can also be made of a transparent material.

Embodiment 4

As a specific embodiment, the difference between the embodiment 3 and the embodiment 4 lies in that the luminous jumping ball further includes: a circuit board 500.

The circuit board 500 is provided with a counting assembly 510, which is configured to count a rotation number of the roller 300. The counting assembly 510 includes a magnet block 511, a Hall sensor 512, and a digital display screen 513. The magnet block 511 is fixedly connected to the rotatable sleeve 350. The counting assembly 510 is fixedly connected to the second half-rod 120 by screws. The Hall sensor 512 is electrically connected to the circuit board 500. The digital display screen 513 is fixedly connected to circuit board 500. The counting assembly 510 is provided with a processing chip. When the rotatable sleeve 350 completes one rotation, the Hall sensor 512 generates an electrical signal, which is transmitted to the processing chip. The processing chip controls the digital display screen 513 to show the numerical value. The processing chip is a known technology, such as a microcontroller or a chip on board (COB) packaged chip.

Specifically, dust-proof shells 540 are also disposed on an exterior of the circuit board 500. The dust-proof shells 540 are a semi-circular groove structure. Two dust-proof shells 540 are both fixedly connected to the second half-rod 120 by bolts. The two dust-proof shells 540 together form a cylindrical outer shell structure.

The second half-rod 120 is also fixedly connected to a storage battery 520, and the storage battery 520 is configured to power the circuit board 500. The storage battery 520 is a polymer lithium battery. The circuit board 500 is provided with a charging and discharging circuit. The charging and discharging circuit is electrically connected to the magnet block 511, the processing chip, the storage battery 520, and the digital display screen 513. The charging and discharging circuit is also electrically connected to a charging port, which is a Type-C charging port.

Embodiment 5

As a specific embodiment, the difference between the embodiment 3 and the embodiment 4 lies in that the luminous jumping ball further includes: a BLUETOOTH™ integrated chip.

The BLUETOOTH™ integrated chip is fixedly connected to the circuit board 500. The circuit board 500 is also fixedly connected to a speaker 530, and the speaker 530 is configured to play music. The BLUETOOTH™ integrated chip is configured to connect to a smart terminal and transmit data. The speaker 530 is configured to play the audio sent from the smart terminal. The BLUETOOTH™ integrated chip, the processing chip, and the speaker are electrically connected.

The terms used in the disclosure are solely for the purpose of describing specific embodiments and are not intended to limit the disclosure. The use of the singular forms "a", "the", and "this" in the disclosure and the claims is also intended to include the plural form, unless the context clearly indicates otherwise. It should also be understood that the term "and/or" used in this document refers to and includes any or all possible combinations of one or more associated listed items.

It should be understood that although the disclosure may use terms such as "first", "second", "third", etc. to describe various information, such information should not be limited to these terms. These terms are only used to distinguish one type of information from another. For example, without departing from the scope of the disclosure, "first" can also be referred to as "second", and similarly, "second" can also be referred to as "first". Depending on the context, the word "if" as used herein can be interpreted as "when" or "in response to determining".

Although embodiments of the disclosure have been shown and described, it will be understood by those skilled in the art that various changes, modifications, substitutions, and alterations can be made to these embodiments without departing from the principles and spirit of the disclosure. The scope of the disclosure is defined by the appending claims and their equivalents.

What is claimed is:

1. A luminous jumping ball, comprising:

a connecting rod, an ankle ring, and a roller;

wherein the ankle ring is fixedly connected to an end of the connecting rod, another end of the connecting rod facing away from the ankle ring is rotatably connected to a rotatable sleeve, the rotatable sleeve is fixedly connected to the roller through a spring, two ends of the spring are fixedly connected to an end of the rotatable sleeve and an end of the roller, respectively, and the spring, the rotatable sleeve, and the roller are coaxially arranged.

2. The luminous jumping ball as claimed in claim 1, wherein the rotatable sleeve is rotatably connected to the another end of the connecting rod facing away from the ankle ring through a bearing.

3. The luminous jumping ball as claimed in claim 1, further comprising:

a first light-emitting assembly, wherein the first light-emitting assembly is located in the roller.

4. The luminous jumping ball as claimed in claim 3, wherein the roller further comprises:

a wheel body, the first light-emitting assembly comprises a first magnetic sleeve, a first coil, and lamp beads, the first magnetic sleeve is rotatably connected to an inner side of the wheel body, the first coil is fixedly connected to the inner side of the wheel body, and the first coil is located outside the first magnetic sleeve and is electrically connected to the lamp beads.

5. The luminous jumping ball as claimed in claim 4, wherein the roller further comprises:

a protective shell, wherein the protective shell is a light-transmitting ring, and the protective shell is fixedly connected to an outer edge of the wheel body, and thereby the protective shell covers outer sides of the lamp beads.

6. The luminous jumping ball as claimed in claim 1, further comprising:

a second light-emitting assembly, configured to generate light on the connecting rod.

7. The luminous jumping ball as claimed in claim 6, wherein the connecting rod is a hollow tube, and the connecting rod defines a plurality of light-transmitting holes; the second light-emitting assembly comprises:

a second magnetic sleeve, wherein the second magnetic sleeve is fixedly connected to the rotatable sleeve;

a second coil, wherein the second coil is located outside the second magnetic sleeve, and the second coil is fixed to the connecting rod; and a light strip, wherein the light strip is electrically connected to the second coil.

8. The luminous jumping ball as claimed in claim 1, further comprising:

a counting assembly, configured to count a rotation number of the roller.

9. The luminous jumping ball as claimed in claim 1, wherein an anti-friction flexible sleeve is sleeved on the ankle ring.

10. The luminous jumping ball as claimed in claim 1, further comprising:

a BLUETOOTH™ integrated chip, wherein the Bluetooth integrated chip is configured to connect to a smart terminal and transmit data, and the Bluetooth integrated chip is electrically connected to a speaker configured to play audio sent from the smart terminal.

* * * * *